United States Patent [19]

Kistner, deceased et al.

[11] 4,247,093

[45] Jan. 27, 1981

[54] METHOD AND APPARATUS FOR LOADING A CIRCULAR SHEET PILE FEEDER

[75] Inventors: Hermann Kistner, deceased, late of Tamm, Fed. Rep. of Germany; by Werner Kistner, executor, Offenbach, Fed. Rep. of Germany

[73] Assignee: Maschinenbau Oppenweiler GmbH, Oppenweiler, Fed. Rep. of Germany

[21] Appl. No.: 59,596

[22] Filed: Jul. 23, 1979

Related U.S. Application Data

[63] Continuation-in-part of Ser. No. 830,038, Sep. 2, 1977, abandoned.

[30] Foreign Application Priority Data

Sep. 3, 1976 [DE] Fed. Rep. of Germany ..... 2639676

[51] Int. Cl.[3] ..... B65H 5/22

[52] U.S. Cl. ..... 271/3.1; 271/225; 271/267; 271/275; 271/151; 414/32; 414/114

[58] Field of Search ..... 271/3.1, 18, 225, 267, 271/275, 151, 149; 414/32, 33, 34, 114, 120

[56] References Cited

U.S. PATENT DOCUMENTS

| | | | |
|---|---|---|---|
| 3,966,059 | 6/1976 | Sase | 414/114 |
| 4,010,945 | 3/1977 | Kistner | 271/151 |

*Primary Examiner*—Richard A. Schacher

*Attorney, Agent, or Firm*—Wigman & Cohen

[57] ABSTRACT

A method of and apparatus for automatically loading a circular sheet pile feeder with successive splayed piles of sheets removed from a stack of sheets disposed on a pallet are disclosed. A pile of sheets of a given height is separated from the stack on the pallet by means of a separating mechanism which forms a gap beneath the pile of sheets in which gap a roller conveyor table is inserted to pick up the pile. The pile is then conveyed upwardly and transversely to a second conveyor table where the pile is deposited and the sheets thereof are tamped into alignment. The second conveyor table transports the pile of sheets to a splaying mechanism where the pile is splayed by gripping one end of the pile, bending the same about an axis parallel to said end and returning the bent end to its normal, unbent position while clamping the pile intermediate its ends. A transfer mechanism then seizes the splayed pile and positions it on the loading table of the circular sheet pile feeder against a previously deposited splayed pile of sheets.

19 Claims, 10 Drawing Figures

METHOD AND APPARATUS FOR LOADING A CIRCULAR SHEET PILE FEEDER

CROSS-REFERENCE TO RELATED APPLICATION

This application is a continuation-in-part application of Application Ser. No. 830,038, filed Sept. 2, 1977, now abandoned.

BACKGROUND OF THE INVENTION

The present invention relates to a process for the loading of a circular sheet pile feeder with sheet piles which are successively taken off a pallet, splayed and placed with the one splayed end to the splayed end of the pile on the loading table of the circular sheet pile feeder, as well as apparatus for performing the process.

The loading of a circular sheet pile feeder is generally effected in such a manner that the operator normally takes a layer off the pile being placed on a pallet and gives it a certain splaying by hand. The operator then places this pile layer on the loading table of the circular sheet pile feeder by resting it against the back end of the exiting pile and then repeatedly passes over the splayed end of the pile with an edged tool until the required splaying is obtained. This process is repeated in relatively short intervals, therefore, as a rule, an operator is continuously required for the loading of a circular sheet pile feeder. Furthermore, the splaying requires care and experience. Additionally, the lifting of the pile layers onto the loading table is heavy physical work, at least in the case of medium-sized and large sheets, particularly in view of the fact that frequently the loading table can only be reached over one or several raised steps.

In recent decades, the continued development of circular sheet pile feeders has consisted primarily of reducing the height of the loading table whereby either the accessibility of the separating table has become more difficult or, owing to the ascending arrangement of the aligning table, the sheet alignment has become more difficult particularly for large size sheets. Therefore, the circular sheet pile feeder has been replaced to a large extent by the flat pile feeder because the latter can pick up the sheets from a pile on a pallet and thus heavy physical work is eliminated for the operator and, on an average, an operator is only required for two to eight minutes per hour for the reloading. However, the increased use of thin paper for multicolor printing makes the process employing a flat pile feeder more difficult since the thin sheets are not as easily separated from each other and the pile surface can be very wavy. Therefore, when processing such sheets, the need arises more frequently to replace the flat pile feeder by a circular pile feeder but, as a rule, this step is only taken when it becomes necessary for reasons of economy.

SUMMARY AND OBJECTS OF THE INVENTION

The invention is based on the objective of providing a process for loading a circular sheet pile feeder which increases the economy of circular sheet pile feeders. In the case of a process of this character, the problem has been solved by the invention in such a manner that each pile of sheets is separated, by means of an automatically operating separating device, from the pile on the pallet and is placed on the table of an automatically operating conveying device. Subsequently, one of the two ends of the pile of sheets to be splayed is seized by an automatically operating splaying device, is at least once bent around a line parallel to the front edges of the sheets of the seized end, then released and again returned into the initial position and the now-splayed pile of sheets is placed automatically against the end of the pile on the loading table.

The process of the invention not only relieves the operator of heavy physical work; in particular, an operator will only be required for the changing of the pallets unless this procedure is not also automated. Since the changing of the pallet only requires a minimum of time and is only to be performed at relatively long intervals, the operator, who has heretofore been required for the loading of a circular sheet pile feeder, is no longer needed. It could, of course, occur that the loading of the circular sheet pile feeder with piles of sheets is somewhat delayed during the changing of the pallets. However, this does not impair the continuous operation of the circular sheet pile feeder since the sheets on the loading table are sufficient to bridge the loading which is interrupted during the changing of the pallets. Another important advantage of the process according to the invention is the fact that the piles of sheets are carefully placed against the end of the pile on the loading table and that, particularly, a separation of all sheets from each other and an absolutely uniform splaying are insured which is of importance for a trouble-free continuous processing of the sheets. Finally, there is the advantage that the necessity heretofore of arranging the loading table in as low a position as possible is eliminated so that an optimum accessibility of the aligning table can be implemented.

So that the separating of a pile of sheets from the pile on a pallet can be effected in a reliable way, it is necessary to place the pallet in a predetermined position which can be done either by hand or by means of a conveying device. However, the precision of the positioning does not have to meet as high requirements as in the case of a flat sheet pile feeder since the aligning of the removed pile of sheets can be effected before being placed on the loading table. It is advantageous if the pallet is exchanged in response to a signal emitted by means of a sensor which indicates that the number of sheets on the pallet has been reduced below a minimum value. This minimum value can be lower than the number of sheets which is separated during the separating process. In this case, the signal is emitted when the sheets on the pallet no longer constitute a complete pile of sheets. However, it goes without saying that the minimum value can also be determined in such a way that at least a complete pile of sheets remains to be taken off the pallet so that the change in pallets can be effected immediately after the last complete pile of sheets is removed.

For reasons of space economy, it is usually advantageous to place the pile of sheets transversely of the conveying device of the circular sheet pile feeder in a position above its loading table. The pallet can then be placed next to the circular sheet pile feeder. But it is, of course, also possible to supply the piles of sheets from the one narrow side to the loading table, i.e., to arrange the pallets behind the circular sheet pile feeder.

In the case of a preferred embodiment, the one end of the pile of sheets to be removed is lifted off by the separating device by forming a space or gap from the remaining pile and is held while the table of the conveying device, starting at the gap, is progressively introduced between the pile of sheets to be taken off and the remaining pile. Such a separation of a pile of sheets can be effected in a simple and reliable manner.

In the case of a preferred embodiment, the pile of sheets, taken from the pallet and placed on the table of the conveying device, is transferred to a second table which directs the pile of sheets to the splaying device and, after splaying, brings the pile of sheets into the position necessary to place it against the pile on the loading table. The transfer of the removed pile of sheets from a first to a second table has the particular advantage of a reduced operating cycle for the two tables resulting in an increased loading speed. Owing to the use of two tables, the sheet supply of the feeder can also be increased since, for example, the next pile of sheets can be taken off the pallet before the preceding pile of sheets had been placed on the loading table. This increased supply of sheets can be utilized to increase the period of time for a change of pallets. Finally, the transfer of the piles of sheets from a first to a second table is also of advantage insofar as, in this case, the necessary exact aligning of the pile of sheets can be effected with the transfer to the second table and, thus, a rough aligning is sufficient when it is transferred to the first table. It is an advantage that the second table carries the pile of sheets during the splaying process. This simplifies the operation and the cost for the performance of the process is kept low.

The invention is also based on the objective of providing an apparatus for the performance of the process according to the invention which is designed as simply as possible, but operates in a reliable manner. This problem has been solved by the invention by means of an automatically operating separating device which seizes a pile of sheets of a given height from a pile on a pallet, an automatically operating conveying device which receives the separated pile of sheets and places it on a table, an automatically operating splaying device arranged at the conveyor of the conveying device and a transfer device for removing the splayed pile from the conveying device and for positioning it on the loading table of the circular sheet pile feeder against the end of the pile. A circular sheet pile feeder combined with such a device combines the advantages of a flat sheet pile feeder with those of the circular sheet pile feeder and avoids the disadvantages of both types of feeders. Thus, the processing of entire piles of sheets, as they are usually stacked on pallets, is possible, and at most, a single operator is required for the changing of the pallets. Moreover, the changing of the pallet does not result in interruption in the feeding of sheets and the forced splaying results in a completely uniform arrangement and in a separation of all sheets from one another. Advantageously, the alignment of the pile of sheets removed from the pallet makes an exact positioning of the pallet unnecessary and the heretofore required elimination of the unevenness of piles in the case of flat pile feeders, as they occur, particularly with sheets to be printed in multicolors which creates difficulties, becomes unnecessary. Also, the transfer by layers and the ventilation of the sheets required in the case of many flat pile feeders, which represents heavy physical work with large sheets, are eliminated.

By means of an additional turning device for the piles of sheets conveyed by the conveying device, a turn of the pile can be effected at relatively low expense since the separated piles of sheets, in comparison with a complete pile, have a lower height and a lower weight and, furthermore, parts of the conveying device, for example, the table, can serve as parts for the turning device. Such a turning device also renders unnecessary the pile turning devices which have heretofore been utilized in connection with printing machines for turning the entire pile on a pallet.

In the case of a preferred embodiment, the separating device has a horizontally placed, driven separating roller, as well as a gripping device for seizing the end of the pile of sheets lifted up by the separating roller. By means of such a separating device, a pile of sheets of a certain height can be reliably and simply separated and the gripping device insures that the sheets of this pile can be transferred without shifting to the table of the conveying device. It is advantageous if the separating roller forms an acute angle with the pile surface confronting it so that it initially comes to rest against the one lateral edge of the pile and, starting from this edge, continuously enlarges the gap toward the other lateral edge. In this manner, even if the sheets are wavy, a trouble-free separation is provided.

It is advantageous if the separated pile of sheets is transferred to the table of the conveying device by introducing the table into the gap between the separated pile of sheets and the remaining pile. With regard to a space-saving design, the table of the conveying device consists, in the case of a preferred embodiment, of several rollers arranged parallel to each other, each roller being rotatable and together the rollers are movable in a guide transversely of their longitudinal axes by means of a driving device. On the basis of such design of the table, that section of the table not presently to be utilized can be arranged in a space-saving manner. For example, this section can be directed vertically upwardly and then, by means of a reversing device, again vertically downwardly. An additional advantage of such a table formed by rollers or rolls resides in the fact that it can be urged beneath the removed pile of sheets by means of a relatively low force since, in this instance, the rollers or rolls can rollably engage the lower side of the pile of sheets. Nevertheless, it is generally necessary to grip the pile of sheets which has been separated by means of the separating roller until it is completely disposed on the table of the conveying device. Such necessity is effected by means of a gripper forming the gripping device.

The separating roller can be arranged in front of the first roller or roll of the table or it can rest on its own supporting structure. Independently of this, it is convenient to select the arrangement of the separating roller with regard to the table in such manner that it lifts the pile layer off the remaining layer to permit the gripping device to seize the pile layer, and, if necessary, lift it further upward before the rollers or rolls of the table engage the pile layer from below since unevenness of the pile of up to about 7 cm is to be taken into account on the pile placed on the pallet.

The lifting movement of the gripping device can be coupled with a corresponding lifting movement of the table. The gripping device can, therefore, be arranged at the carrying structure of the table. Since the level of the table must be adapted to different pile heights, the guiding devices are arranged, for reasons of expediency, in a carrying structure in a height-adjustable manner. This carrying structure can, for example, also carry the driving motor for the adjustment in height. In case of a loading of the circular sheet pile feeder from one side, an adjustability of the table in a transverse direction, i.e., in the direction of the axes of the rollers, is required. In the case of a preferred embodiment, the entire carrying structure is movable in a transverse direction for this purpose.

If, as is preferred, the conveying device has a second table movable within guides and which can be moved from one position, in which the pile of sheets has been transferred to it from the first table, into positions in which the splaying device splays the pile of sheets and the transfer device places the splayed pile of sheets against the end of the pile on the loading table, then a higher loading speed is obtained without having to increase the operating speed of the individual devices. Furthermore, a larger supply of sheets is obtained in this manner, thereby increasing the period of time available for changing the pallets. The use of a second table also simplifies the aligning of the piles of sheets since this aligning can be effected during or after the transfer. The splaying device is preferably arranged adjacent the free end of the loading table and at the end of the guideway of the second table, which is movable above the loading table in its longitudinal direction. After the transfer of the pile of sheets, the second table then need only be guided to the splaying device and, after the splaying operation, back into the correct position for the transfer onto the loading table.

In the case of a preferred embodiment, the splaying device has a holding device provided with at least one hold-down device urging the sheets, in its operating position, against the table carrying them, as well as a bending device, with at least one clamping device holding, in its operating position, the sheets of the overhanging end of the pile of sheets together in turn with the hold-down device in such a manner as to prevent such sheets from moving. The bending device is arranged subsequently of the hold-down device and bends the end of the pile of sheets overhanging the adjacent side of the table along a line extending transversely with respect to the shifting device of the sheets during splaying and then returns to its initial position. The structural requirements for the splaying device are very simple, nevertheless, a completely uniform splaying is insured. The bending can be effected upwardly or downwardly and with the end of the pile of sheets either held together or kept free whereby, however, the direction of the splaying depends on the selected possibilities. In order to also support the end of the pile overhanging the second table in the splaying device, which support is particularly important in case of a substantial splaying, it is advantageous for the bending device to have, for the overhanging end of the pile of sheets, a supporting table pivotable about the bending line or a line parallel to it.

Before the splayed pile of sheets is placed on the loading table, it must be insured that it will lie directly adjacent the end of the pile on the loading table. Furthermore, care must be taken that the sheets, when the pile of sheets is lifted off, maintain this alignment with the end of the pile. The alignment with the end of the pile is preferably effected by means of a sensor of the transfer device which responds to the end of the pile on the loading table and controls the motion of the second table. So that the pile of sheets maintains the alignment with the end of the pile on the loading table, the transfer device has, in the case of a design with which the second table carrying the splayed pile of sheets is directed toward the transfer device in the guide motion of the end of the pile and then directed away in the opposite direction, a gripping device which is independently movable of the second table and can seize the splayed end. This gripping device holds the end of the pile until the second table has been completely pulled away from under the pile of sheets. If a transfer of the splayed pile of sheets to the loading table is to be effected at right angles to the direction of supply of the circular sheet pile feeder, the gripping devices can also be replaced by a stripping device.

It is advantageous to have as a sensor a photodetector responding to the end of the pile and, if a gripping device is provided, the photodetector is arranged at a selected distance from the gripping device. The distance is then selected in accordance with the format of the sheets in such a manner that, when the photodetector detects the rear end of the pile, the gripping device holds the front end of the splayed pile of sheets in its position against the pile. The photodetector, for example, can be located to sense the end of the pile from a lateral position with its beam directed diagonally downwardly or can be arranged under the loading table and effect the sensing through a slot in the loading table.

BRIEF DESCRIPTION OF THE DRAWINGS

Below, the invention is explained in detail by means of an embodiment of the apparatus according to the invention shown in the drawings, wherein.

DETAILED DESCRIPTION OF A PREFERRED EMBODIMENT

Figure 1:
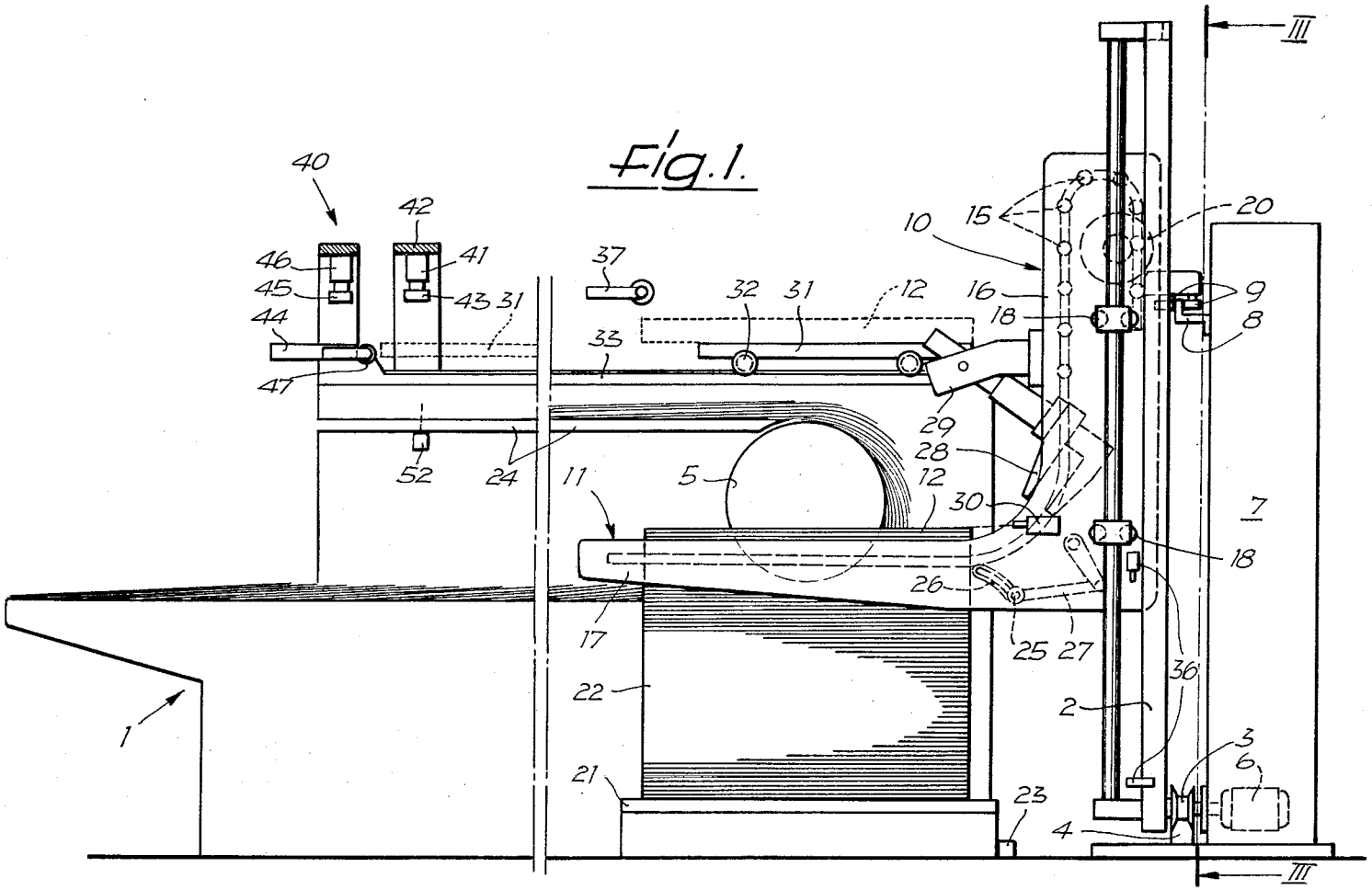
FIG. 1 is a side view of an embodiment of the invention.

A fully automatically operating device for the loading of a circular sheet pile feeder 1 has a flat, vertically arranged carrying structure 2 which, in the illustrated embodiment, is constructed in a frame-like manner. At the lower end of structure 2, rollers 3 are provided which rest on a guide rail 4 fixed to the floor or to a foundation. The guide rail 4 is arranged, as is, for example, shown in FIG. 1, a short distance behind the reversing roller 5 of the circular sheet pile feeder and parallel to the axis of rotation of the reversing roller. Furthermore, the length of the guide rail 4 is, as is particularly shown in FIG. 3, selected such that the carrying structure 2 is movable between a position in which it is aligned with the back of the circular sheet pile feeder 1 and a position in which it is aligned with the space next to the circular sheet pile feeder shown in FIG. 3 on the left-hand side.

In the illustrated embodiment, this movement is effected by a rotating chain shown in broken lines by means of a motor 6. In order to maintain the carrying structure 2 in a vertical position, a supporting structure 7 is provided and is located adjacent the carrying structure 2 on the side thereof away from the circular sheet pile feeder 1. This supporting structure 7 carries, near its upper end, a guide rail 8 extending parallel to the guide rail 4 and engaging between two pairs of guide rollers 9. It should be understood that the guide of the carrying structure 2 could, of course, also be designed in another manner.

The carrying structure 2 forms a part of the conveying device and carries a guide 10 of a first table 11 on which, initially, each pile of sheets 12 is placed after having been removed automatically from a pile 22 on a pallet 21. The table 11 is, for example, as shown in FIG. 1, formed by freely rotating rollers 15 arranged parallel to each other with their laterally projecting axle journals each being connected by a roller chain and being supported by two guide cheeks of the guide 10 so as to be movable transversely of the longitudinal direction of the rollers. The guide cheeks each have, as is, for example shown in FIG. 1, an arm 16 projecting in the vertical direction and an arm 17 connected to its lower end and projecting in the horizontal direction from the carrying structure 2 towards the circular sheet pile feeder 1 and into the free space adjacent thereto. The two arms 16 are, for example, guided by means of guide rollers 18 on the carrying structure 2 and their heights are adjustable. An electric motor 19 attached to the carrying structure 2 effects the raising and lowering of the guide 10 by means of a rotating chain.

The guideway of the rollers 15 runs horizontally in the two arms 17 and passes then, over a curved section, into the vertical part of the arms 16. In the range of the upper end of the arms 16, a semicircular guideway section, directed toward the supporting structure 7, follows which, in its turn, is followed by a terminal section directed toward the bottom. By means of this course of the guideway, the momentarily not required part of the table 11 can be arranged in a space-saving manner. An electric motor 20 (FIGS. 1 and 4) transports the two roller chains for the rollers 15, which can also bear a load during thrust, in opposite directions and thus moves the rollers 15 either toward the free end of the arms 17 or in the opposite direction. The distance between the arms 17 is greater than the maximum width of the sheets which will be supplied to the circular sheet pile feeder 1. Furthermore, the length of the arms 17 and the length of the first table 11 is, at least, equal to the maximum length of these sheets.

By means of stops 23, the pile 22, the sheets thereof with which the circular sheet pile feeder 1 is to be loaded and which pile is generally placed on the pallet 21, is positioned in the space next to the circular sheet pile feeder 1, with which the carrying structure 2 and the guide 10 are to be aligned, in such a manner that the pile is located between the two arms 17 of the guide 10 when the arms are correspondingly lowered and such that the upper edge of the pile facing the carrying structure 2 is located parallel to the longitudinal axes of the rollers 15. However, an exact positioning of the pile 22 is not required since the sheets removed from the pile 22 are precisely aligned before they are placed on the loading table 24 of the circular sheet pile feeder 1.

Figure 2:
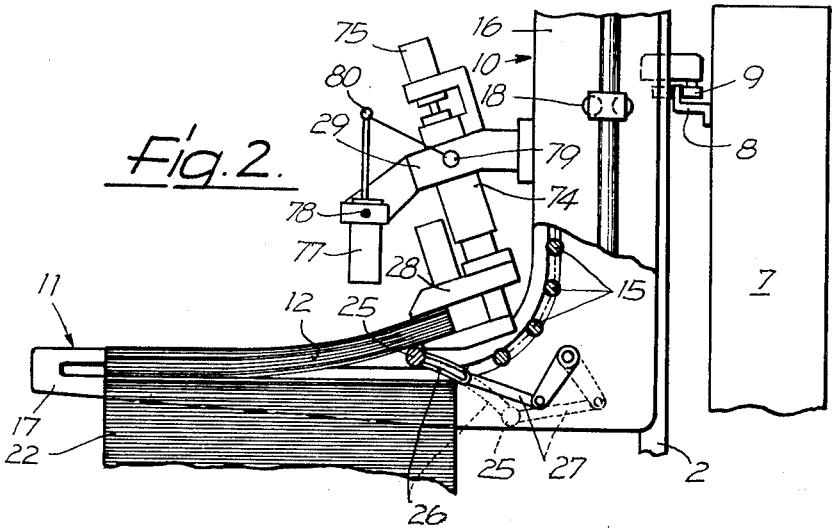
FIG. 2 is a fragmentary side view at the time of the beginning of the lifting-off process of a pile of sheets.

In order to be able to automatically remove a pile of sheets from the pile 22, it is necessary to first separate such pile of sheets from the remaining pile. For this purpose, a continuously or intermittently rotatably driven separating roller 25 is provided which, as shown in FIG. 2, is supported beneath the guideway of the rollers 15 in the arm 17 so as to be movable transversely of its longitudinal direction. The movement of guideway 26 of the separating roller 25 starts, as is shown in dotted lines in FIG. 2, at a distance from the side of the pile confronting the carrying structure 2 and follows a curved path upwardly and away from the carrying structure 2. The separating roller 25 is arranged in this guideway 26 in a slightly canted manner so that, when it is moved, for example, by means of a pair of thrust cranks 27 from the lower to the upper end of the guideway 26 in the direction according to FIG. 2, i.e., from right to left, it initially contacts the pile 22 in the region of one lateral edge of the pile. Since the separating roller 25 is rotating in a direction to lift the sheets from the pile 22, i.e., in a clockwise direction according to FIG. 2, the separating roller 25 first lifts a pile of sheets by one corner, forms a gap and enlarges, as it further approaches the upper end of the guideway 26, the gap between the pile of sheets 12 and the remainder of the pile 22 toward the other lateral edge of the pile. At the upper end of the guideway 26, the separating roller 25 is, as is shown in FIG. 2, inside the gap.

Figures 5, 6, 7, 8, 9, 10:
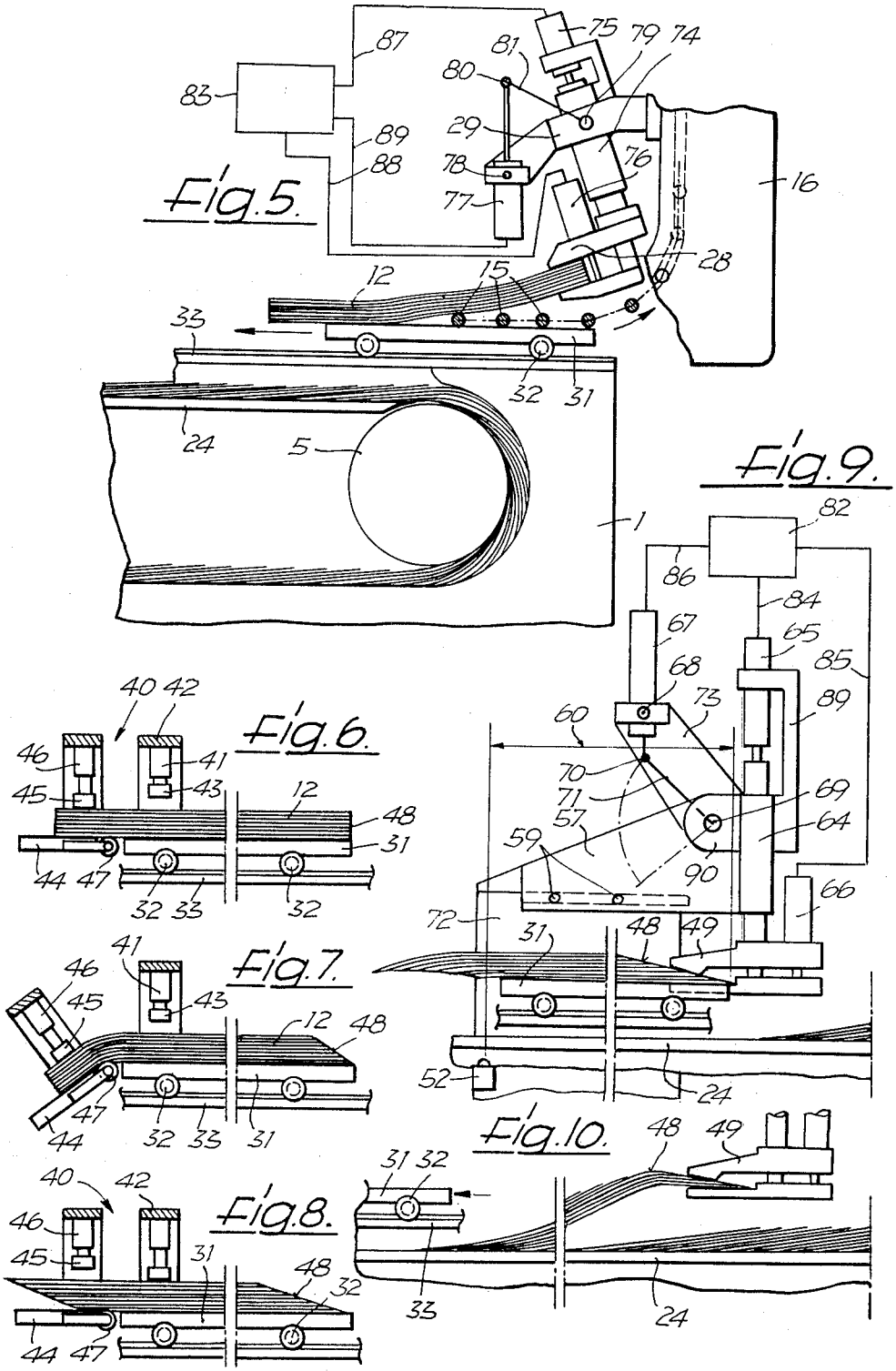
FIG. 5 is a cross-section view along the line V—V of FIG. 4.
FIGS. 6 to 8 are fragmentary side views of the splaying device at various points in time during the splaying process.
FIG. 9 is a side view of the splaying device and the transfer device before the transfer process is initiated.
FIG. 10 is a side view of the transfer device during the transfer process.

The lifted-up end of the pile of sheets 12 is now seized by a gripping device 28 which may be pneumatically operated by conventional control means 83 shown in FIG. 5 and which is supported in a pivoting manner in a carrying arm 29 fixed to the guide 10 for pivotable movement about an axis parallel to the axis of rollers 15. As soon as the separating roller has reached the upper end of the guideway 26, the gripping device 28 is pivoted clockwise, according to the showing of FIG. 2, into the gripping position and then closed. After having been closed, the gripping device 28 lifts the seized end of the pile of sheets to such an extent that the rollers 15 can be introduced into the gap between the pile of sheets 12 passing above the separating roller 25 and the remainder of the pile 22. However, the separating roller 25 can also be returned to the lower end of the guideway 26 before introducing the rollers 15 into the gap between the lifted-off pile of sheets and the remainder of the pile. In this manner, the entire gap is free for the rollers 15 so that further lifting of the end of the pile of sheets by the gripping device after it has seized the end of the pile of sheets is unnecesary. The gripping device 28 not only remains closed during, but after the shifting of the pile of sheets onto the table 11, which is effected by moving the rollers 15 towards the free end of the two arms 17 until the seized pile of sheets is entirely lifted off the pile 22.

The control formed by the control means 82 and 83 for grippers 49 and 28, respectively, is a so-called follow control, i.e., the individual commands are not performed until the previous command has been performed.

The gripper 28 is opened by the cylinders 76 to grasp the floor rod and, if necessary, is aligned with the end of the stack to be grasped by means of the cylinder 75. As soon as it is pivoted by means of the cylinder 77 into the position shown in FIG. 5, it is then closed by means of cylinder 76. The subsequent lifting is accomplished by means of the cylinder 75.

As shown in FIG. 5, the gripper 28 is opened and closed by the pneumatic cylinder 76. The height adjustment of the gripper 28 is accomplished by means of the pneumatic cylinder 75. The gripper 28 is moved in the guide tube 65 shown in FIG. 9 by means of this height adjustment, which guide tube 65 is mounted on the support arm 29 to be pivotable about the axis 79 shown in FIG. 5. A pivot arm 81 projects radially from the axis 79 which is rigidly connected with the guide tube 64 shown in FIG. 9, and the piston rod of a pneumatic cylinder 77 shown in FIG. 5 is hinged to this pivot arm 81, which pneumatic cylinder 77 is also mounted on the support arm 29 so as to be pivotable about the axis 78.

The height of the separated pile of sheets is determined by means of a sensor 30 which, in the illustrated embodiment, is a light sensor responding to the upper edge of the pile 22. The sensor 30 is fixed at the guide 10 in a height-adjustable manner and terminates the lowering motion of the guide 10 when it detects the upper edge of the pile. The separating roller 25 then comes to reset against the pile 22 at the desired adjustable distance from the upper edge of the pile. After the transfer of the pile of sheets onto the first table 11 or after the table has been fully extended, the guide 10 and thus also the table 11 are initially brought into their highest position in which the lower side of the arms 17 is higher than a second table 31 of the conveying device. This vertical movement of the guide 10 is followed by a transverse motion of the carrying structure 2 along rail 4 whereby the first table 11 is positioned above the loading table 24. The second table 31 of the conveying device is arranged at a distance above the upper side of the loading table 24 which is somewhat greater than the maximum height of the pile resting on the loading table 24. This second table 31 is designed as a plate and travels by means of rollers 32 on rails 33 thereby permitting a shifting of the second table in the longitudinal direction of the loading table. Rails 33 are also rigidly connected to the loading table 24 without projecting into the contact surface of the sheets. By means of an electric motor 34 and a laterally arranged, endless chain, the second table 31 can be shifted in both directions of motion.

The transfer of the pile of sheets from the first table 11 to the second table 31 is effected in such a way that the latter is moved to the end of its course of motion superposed adjacent the reversing roller 5 in which the second table is below the first table 11 when it is in its transfer position. The first table 11 is then retracted, i.e., the rollers 15 are withdrawn or moved away from the free ends of the arms 17 while the gripping device 28 is still closed. In this way, the pile of sheets is gradually shifted to the second table 31 beginning with the end thereof opposite the end seized by the gripping device 28. After the first table 11 has been fully withdrawn, the gripping device 28 is opened and pivoted counterclockwise into its initial position as viewed in FIG. 5. Immediately thereafter, the carrying structure 2 is again automatically moved into the position wherein the guide 10 is aligned with the pile 22. Subsequently, the guide 10 is lowered to the level required for the separation of the next pile of sheets. A second sensor 36 shown in FIG. 1 is provided at the guide 10, which, however, could also be arranged at the carrying structure 2, and emits a signal when the guide 10, controlled by the sensor 30, will be lowered to such an extent that, only a certain number of piles of sheets of the desired height, for example, only another one pile of sheets, can be taken off the pile 22. When this signal is emitted, the change in pallets must be prepared.

After the guide 10 has reached the correct level for the removal of the next pile of sheets 12, the aforedescribed process is again initiated. However, after the running up of the guide 10 into its highest position, the operating cycle is interrupted before the movement of the carrying structure 2 is effected if, at this point in time, the second table 31 is not in its transfer position. For this purpose, a limit switch can be provided which can be actuated from the second table 31 and is located in the control circuit of the motor 6 which effects the motion of the carrying structure.

An adjustable lateral stop 35 is provided for an exact alignment in the transverse direction of the pile of sheets on the second table 31, this adjustable lateral stop 35 being arranged laterally adjacent the second table 31 when this table is in its transfer position. Lateral stop 35 is movable in the transverse direction of the second table and has fingers at its lower end which can be introduced in lateral recesses of the second table in order to move all sheets of the pile on the second table to a sufficient extent in the transverse direction and to align them in this manner. The lateral stop 35 is then retracted whereby the second table 31 is freed.

Since the position of the end of the pile of sheets on the second table 31, which had been first seized by the gripping device 28, is independent of the length of the sheets, e.g., this end of the pile has the same position in the case of all piles of sheets with regard to the adjacent side of the second table 31, the position of the other end of the pile, referred to hereinbelow as the second end of the pile, is dependent on the length of the sheets with regard to the other side of the second table which will be referred to hereinbelow as the second side. However, the second end of the pile must project over the second side of the second table 31 to a certain extent for the automatic splaying of the pile of sheets to be subsequently performed. In order to obtain this projection, the second table 31 is moved below a longitudinal stop 37 in the direction toward the outward end of the loading table 24. The longitudinal stop 37 extends transversely across the loading table 24, is located outside the area of the movement of the arms 17 of the guide 10 and permits the second table 31 loaded with a pile of sheets to move beneath it and is pivoted into its operating position wherein its fingers extend to a point below the surface of the second table 31. The fingers of the longitudinal stop 37 can engage in longitudinal notches of the second table 31 whereby it is insured that all sheets are engaged when the second table 31 is subsequently moved until the second end of the pile of sheets held by the longitudinal stop 37 projects beyond the second side of the second table 31 to the extent required for splaying. Subsequently, the longitudinal stop 37 is pivoted back into its horizontal rest position and the second table 31 is moved to the end of its guideway adjacent the outermost free end of the loading table 24.

Above the free end of the loading table 24, an automatically operating splaying device is arranged which is designated generally by reference numeral 40. This splaying device has, in the illustrated embodiment, a pneumatically operated holddown device 41 which is supported by a bridge 42 spanning the second table 31. The clamping strip 43 of the hold-down device can be moved upwardly a sufficient distance so that the second table 31 with the pile of sheets resting thereon can be moved below the strip 43. In the final position of the second table 31 shown in FIG. 1 in dotted lines, the clamping strip 43 is aligned with the outer section of the carrying surface of the second table 31, i.e., adjacent the second side thereof.

The projecting second end of the pile of sheets is guided onto a supporting table 44 of the splaying device 40. There is a small space between table 44 and the second side of the second table 31. As is shown in FIG. 7, the supporting table 44 can be pivoted about an axis parallel to the second side of the second table and only slightly lower than the plane defined by the support surfaces of the second table 31 and the supporting table 44. The pivoting axis is thus also parallel to the front edge of the second end of the pile projecting over the second table.

Carried by a bridge laterally fastened to the supporting table 44, there is arranged, above the section of the contact surface of the supporting table 44 adjacent to the second table 31, a clamping jaw 45 extending transversely across the supporting table which, in the given example of a design, can be urged toward the supporting table 44 by means of a pneumatic unit and can be raised to such an extent that a pile of sheets 12 can be passed between the clamping jaw 45 and the supporting table 44. The end of the supporting table confronting the second table 31 is formed in the illustrated embodiment by a freely rotating roller 47 having a relatively small diameter, the longitudinal axis of which coincides with the pivot axis of the supporting table 44 and which is tangential to the plane defined by the contact surface of the second table 31.

After the second table 31 has been moved into the position directly adjacent to the supporting table 44 and the projecting end of the pile of sheets to be splayed has been urged over the roller 47 onto the supporting table 44, the clamping jaw 45 is pressed against the supporting table with a sufficient force that all sheets of the second end of the pile are held by a hold-down device 46 so that they cannot be moved (FIG. 6). Subsequently, the supporting table 44 is pivoted counterclockwise as viewed in FIGS. 1 and 6, by a predetermined angle of about 30°. The pile of sheets is thus subjected, in the area above the roller 47, to a bending or curving which results in a separation of all sheets from each other and in a uniform splaying at the first end 48 of the pile 12. The hold-down device 41 is now actuated and the clamping strip 43 is urged against the second table 31 with sufficient force that all sheets of the pile are immovably clamped within the clamping area. Subsequently, the clamping jaw 45 is raised from the end of the pile and the supporting table 44 is pivoted back into its initial position as shown in FIG. 8. During this return pivoting, the splaying previously effected at the first end of the pile 48 is also applied to the second end of the pile. If the splaying obtained in this manner is not sufficient, the above described operating cycle can be repeated once or several times. With each repetition, the splaying is increased by the same amount as with the first cycle.

Figure 3:
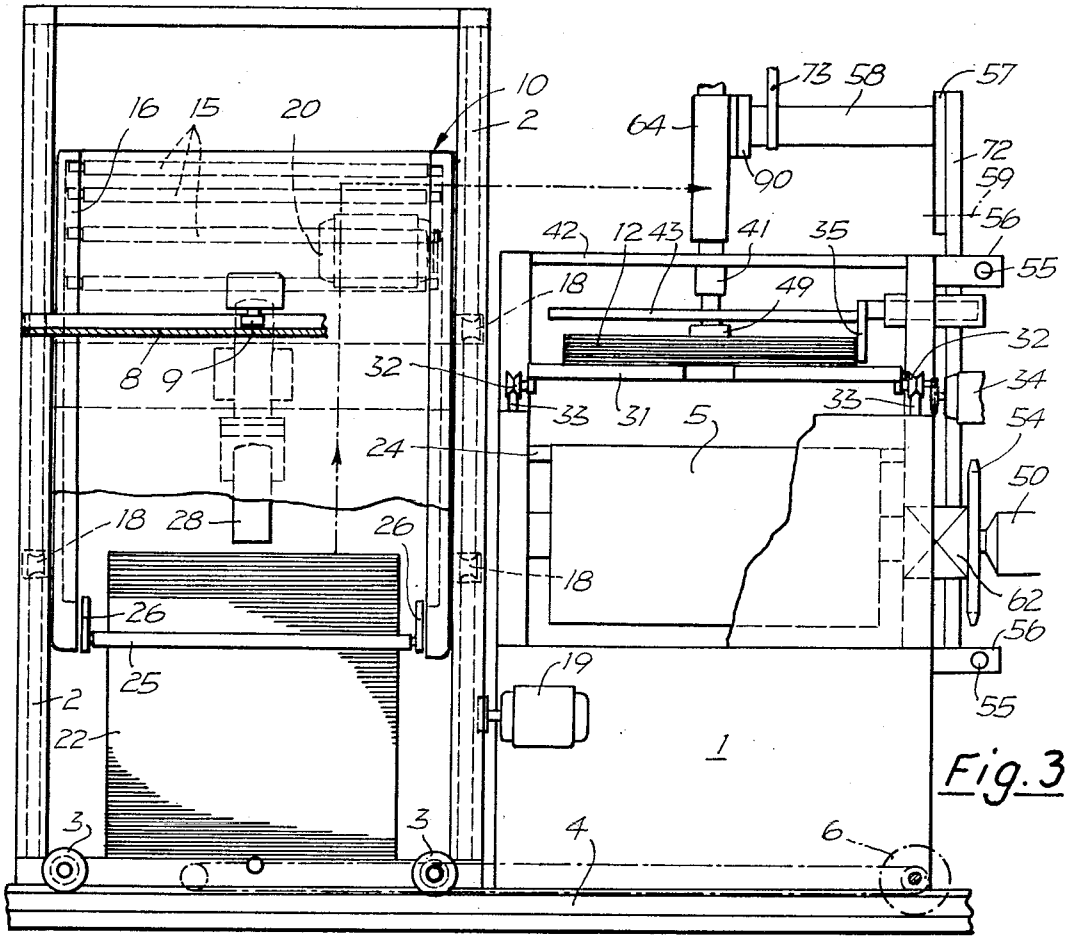
FIG. 3 is a cross-section view along line III—III of FIG. 1.
Figure 4:
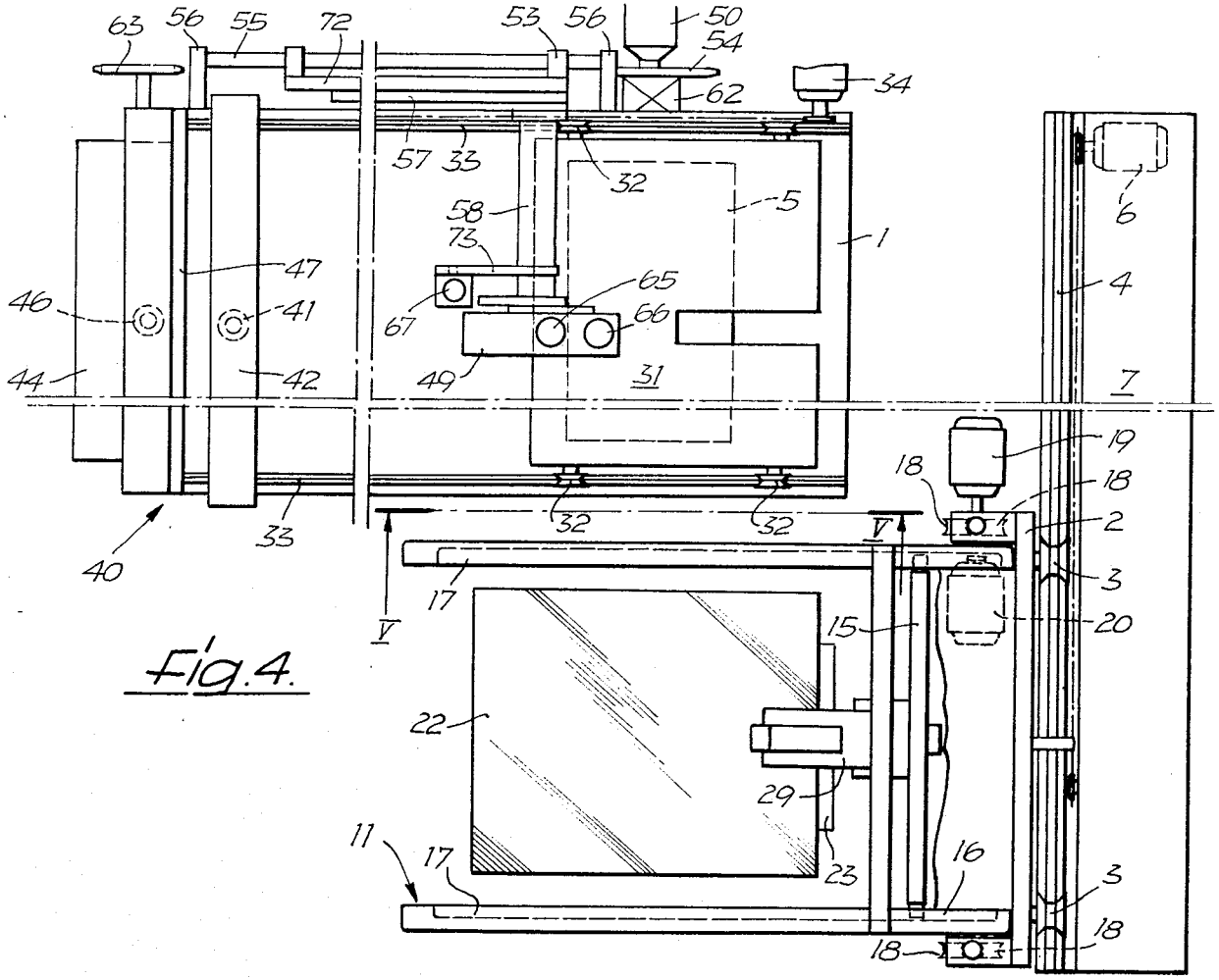
FIG. 4 is a top view of the embodiment of the invention.

After the desired splaying has been obtained, a gripping device 49 (FIG. 9) is automatically shifted by conventional control means 82 to the free end 48 of the pile. The gripping device 49 is movable in the same direction as the second table 31 and is guided in a side guide. The side guide is formed, as shown in FIGS. 3 and 4, by guide plates 57 and 72, guide blocks 53, support 56, and guide rods 55. Electric motor 50 is provided for effecting longitudinal motion of the gripping device 49 which motor drives two laterally arranged, rotating chains. See FIG. 4. The path of travel of the gripping device 49 extends beyond the end of the path of travel of the second table 31 adjacent the reversing roller 5 to a point wherein the gripping device 49 does not interfere with the transfer of a pile of sheets from the first table 11 onto the second table 31. As soon as the gripping device 49, which engages into one or several of the longitudinal slots (FIG. 4) of the second table 31, has seized the splayed, free end of the pile 48, it is moved away, together with the second table 31 and at the same speed, from the splaying device 40 until a scanning photodetector 51 (FIG. 9), which is arranged under the loading table 24 and through a slot in the loading table, has detected the rear edge of the last sheet of the pile of sheets on the loading table 24. The photodetector 51 is rigidly connected with the gripping device 49 over an arm and at a selectable distance from it so that the distance between photodetector 51 and the gripping device 49 is selected so as to be equal to the legnth of the sheet. In this way, it is insured that, when the light barrier 51 has detected the rear end of the pile on the loading table 24, the front edge of the pile of sheets held by the gripping device 49 is aligned with the front edge of the last sheet of the pile on the loading table. The conveying speed of the gripping device 49 is now adapted to the conveying speed of the pile on the loading table and in such a manner that the drive of the gripping device is coupled with the drive of the conveying device of the loading table. The second table 31, in turn, is moved toward the splaying device 40 until it is completely pulled away from beneath the pile of sheets. The gripping device 49 is then opened and is moved, passing over the pile on the loading table, into its terminal position adjacent the reversing roller 5. The second table 31 is then moved into this terminal position.

Owing to the fact that the splayed pile of sheets can always be deposited on that point of the loading table where the end of the previously positioned pile is located, it is possible to deposit the splayed pile of sheets without any delay after the splaying. Therefore, the depositing can normally be effected sufficiently rapidly so that the length of the pile on the loading table remains normally at its maximum value. In this manner, there is always a sufficiently large stock available, particularly for the change of pallets, during which the loading can be interrupted. Therefore, generally, the depositing of a splayed pile of sheets after the change of a pallet will be effected nearer to the reversing roller 5 than normally. However, the point where the depositing of the pile of sheets is effect on the loading table moves step-by-step towards the splaying device 40 until the maximum length of the pile is again reached. Exceeding of this length of the pile is prevented by the fact that a sensor 52 is arranged on the loading table 24 which is a photodetector operative to permit movement of the second table 31 and the gripping device 49 from the splaying device 40 only when sensor 52 is no longer covered by the pile on the loading table.

Since the gripping device 49 can be moved relative to the second table 31, the pile of sheets deposited on the second table could also be urged in the direction of the splaying device 40, with the second table standing still, by means of the gripping device 49, instead of with the longitudinal stop 37, until the second end of the pile of sheets projects to the extent necessary for the splaying.

The gripper 49 is pneumatically opened and closed like the gripper 28. The opening and closing of the gripper 49 is accomplished by means of the cylinder 66. The height adjustment of the gripper 49 is accomplished by means of cylinder 65 at its pivoting motion about axis 69 by means of cylinder 67.

The activation of the gripper 49 shown in FIG. 9 is accomplished in the same manner as the activation of the gripper 28 shown in FIG. 5. The pneumatic cylinder 66 opens and closes the jaws of the gripper 49 which is guided in the guide tube 64 in a height adjustable manner. The upper end of the portion of the gripper 49 guided in the guide tube 64 is connected with the piston rod of the pneumatic cylinder 65 which is rigidly connected with the guide tube 64 by means of a support arm 89. The guide tube 64 is attached to a stud 90 which is pivotably mounted on the axis 69 held by the support arm 58 shown in FIG. 4. The gripper 49 is therefore pivotal about the axis 69 shown in FIG. 9. This pivoting motion is effected by means of the pneumatic cylinder 67, the piston rod of which is connected with a pivot arm 79 shown in FIG. 5 by means of a hinge 70 shown in FIG. 9, which pivot arm 71 projects radially from the stud 90 and is rigidly connected therewith. The pneumatic cylinder 67 is supported by a support 73 attached to the support arm 58 shown in FIG. 4.

The gripper 49 is slidable in the same direction as the second table 31. It must, however, also be pivotable about a horizontal axis like the gripper 28. It is, therefore, pivotably arranged on the free end of a horizontal support arm 58. The pivot device can operate pneumatically or electromagnetically. The other end of the support arm 58 is rigidly attached to a plate 57, which in turn is screwed to a guide plate 72. As FIG. 9 shows, the guide plate 72 is provided with a horizontal longitudinal slit, which is penetrated by the attachment screws 59 of the plate 57. Accordingly, after the screws 59 are loosened, the plate 57 can be removed relative to the guide plate 72 in the longitudinal direction of the slit. The adjustability of the plate 57 is necessary in order to be able to adjust the gripper 49 to the sheet size. For this purpose, the gripper 49 must be displaced relative to the photodetector 51 by a distance designated as 60 in FIG. 9, which distance 60 corresponds to the length of the sheet.

The side guide for the gripper 49 is located on the same side of the circular stack sheet feeding device 1 as the side stop 35 (FIG. 3), that is, on the side opposite the table 11. The side guide is formed also in part by the guide plate 72, which lies in a vertical plane. Guide supports 53 shown in FIG. 4 are welded or screwed to the outer surface of the guide plate 72. With the aid of these guide supports 53, the guide plate 72 is mounted so as to be longitudinally movable on two guide rods 55. The two parallel guide rods 55 lie at the sides of the guide plate 72 and extend in the direction of movement of the guide plate 72. The end of the two guide rods 55 are each connected with a support 56. These supports 56 are attached on the sides of the circular stack sheet feeding device 1, that is, they have a permanent location. The electric motor 50, which causes the longitudinal movement of the gripper 49, is arranged on the same side of the circular stack sheet feeding device 1 as the guide plate 72. The motor 50 drives a chain sprocket 54, over which runs an endless chain (not shown). This endless chain is guided in the direction of the guide rods 55 to a second chain sprocket 63, which is rotatively mounted on the outside of the circular stack sheet feeding device 1. The endless chain is connected with guide plate 72 at a location which allows the guide plate 72 to be carried in one direction or the other depending on the rotational direction of the motor 50.

The control of the movement of the gripper 49 can be accomplished in the following manner. If a sensor 61, for example, a switch or a light beam shown in FIG. 8, reports that the stack lying on the table 31 has attained the desired splayed condition, then the table 31 moves in the direction toward the diverting drum 5. At a predetermined location, where a switch or a light beam produces a signal, the table 31 stops with the splayed stack 12. Driven by the motor 50, the guide plate 72 now travels with the gripper 49 toward the table 31 until it reaches another predetermined location. Thereafter, the gripper, which heretofore has been pivoted upward so that the table 31 with the stack 12 could travel beneath it, is pivoted into the position shown in FIG. 9. The jaws are then closed. Once the gripper 49 has taken hold of the stack, as shown in FIG. 9, the motor 50 is again engaged, and, namely, in such a manner that the guide plate 72 and the gripper 49 move together toward the diverting drum 5, i.e., to the right in a view according to FIG. 9. If the photodetector 51, which is adjusted to the length of the sheet, reports that the front edge of the stack has reached the end of the stack already lying on the supply table of the circular stack feeding device 1, then the movement of the gripper 49 and the guide plate 72 is ended and the chain sprocket 54 is coupled with the shaft of the diverting drum 5 with the aid of a coupling 62 such as an electromagnetically activatable coupling. From this point on, the gripper 49 should move at the same speed as the stack already lying on the supply table, so that there is no longer any shifting between this stack and the stack taken hold of by the gripper 49. Subsequently, the table 31 is moved away in the direction of the splaying device 40 below the stack. As it does so, the stack 12 is layed on the supply table of the circular stack sheet feeding device 1. The jaws of the gripper 49 are then opened and the gripper 49 is pivoted away, that is, counter clockwise in a view according to FIG. 9. In so doing, it is pivoted upward to such a degree that it can then be moved away about the stack toward the splaying device 40.

Although only a preferred embodiment is specifically illustrated and described herein, it will be appreciated that many modifications and variations of the present invention are possible in light of the above teachings and within the purview of the appended claims without departing from the spirit and intended scope of the invention.

What is claimed is:

1. In a method of loading a circular sheet pile feeder with piles of sheets removed successively from a stack of sheets, comprising the steps of:

automatically separating a pile of sheets from the stack of sheets, said pile of sheets having first and second ends;

automatically conveying the separated pile of sheets to a splaying device;

automatically splaying said pile of sheets by griping the second end of said pile of sheets, and bending said second gripped end about an axis parallel to said second end;

releasing the gripped second end of the pile of sheets and returning said pile of sheets to an unbent, splayed condition; and automatically positioning said splayed pile of sheets on said circular sheet pile feeder.

2. The method according to claim 1, including the steps of positioning the stack of sheets in a predetermined position for separation, detecting the removal of piles of sheets below a minimum height of the stack of sheets, generating a signal when the height of said stack of sheets is below the minimum, and replenishing the stack of sheets.

3. The method according to claim 1, including the steps of positioning the stack of sheets laterally adjacent the circular sheet pile feeder, said circular sheet pile feeder having a conveying direction, conveying the pile of sheets transversely to the conveying direction of said feeder and above said feeder.

4. The method according to claim 1, wherein said automatic separating step includes the step of lifting one of said ends of the pile of sheets, forming a gap between said pile of sheets and the remainder of the stack of sheets, and progressively introducing a conveying device into said gap.

5. The method according to claim 1, wherein said automatic conveying step subsequently includes the step of transferring the pile of sheets from a conveying device to the splaying device.

6. The method according to claim 1, wherein the second end of the pile of sheets projects beyond an end of a conveying device which conveys the same to the splaying device and wherein said gripping step includes the step of gripping the projecting second end of the pile of sheets such that the sheets are prevented from shifting relative to one another and, including the further step of, after said bending step and before said releasing step, gripping the pile of sheets in a region intermediate said first and second ends such that the sheets are prevented from shifting relative to one another.

7. Apparatus for automatically loading a circular sheet pile feeder with piles of sheets from a stack of sheets, comprising:

means for automatically separating a pile of sheets having a given height from the stack of sheets;

means for automatically subsequently splaying the pile of sheets;

conveying means for picking up the pile of sheets separated from the stack of sheets and for conveying the same to said splaying means;

means, cooperating with said conveying means, for transferring a pile of sheets splayed by said splaying means to the circular sheet pile feeder; and wherein said separating means comprises a driven separating roller, means for urging said separating roller against the stack of sheets to separate the pile of sheets and means for gripping a first end of the separated pile of sheets.

8. Apparatus according to claim 7, wherein said separating roller forms an acute angle with the first end of the pile of sheets.

9. Apparatus according to claim 7, wherein said conveying means includes a first table means for picking up the pile of sheets separated from the stack of sheets, guide means, having a horizontal section, for supporting said first table means and a storage section for storing said first table means, said first table means comprising a plurality of rotatable rollers each having a longitudinal axis and arranged in spaced, parallel relation to each other, said rollers being movable between the horizontal and storage sections of the guide means along a path of travel directed transverse to their longitudinal axes, means for moving said rollers along said path of travel, and means for vertically moving said guide means.

10. Apparatus according to claim 9, wherein said conveying means further includes a second table means for moving the pile of sheets along a guideway between first and second positions, means for transferring the pile of sheets from said first table means to said second table means when said second table means is in said first position, said splaying means being operative to splay the pile of sheets when said second table means is in said second position.

11. Apparatus according to claim 10, wherein a loading table of the circular sheet pile feeder has a free end, said second table means being movable at a distance above the loading table along the length of said loading table, said splaying means being arranged at one end of the guideway of the second table means and adjacent the free end of the loading table.

12. Apparatus according to claim 7, wherein said splaying means includes means for gripping the second end of the pile of sheets to prevent relative movement between the sheets at the gripped second end, and means for bending and unbending the gripped second end of the pile of sheets about a bending axis parallel to the gripped second end thereof, and means for clamping the bent pile of sheets at a region intermediate the first end and the second end thereof to prevent relative movement between the sheets at said intermediate region.

13. Apparatus according to claim 12, wherein said bending and unbending means includes a supporting table for the second end of the pile of sheets, said supporting table being pivotable about an axis parallel to said bending axis.

14. Apparatus according to claim 7, wherein said transferring means includes at least one gripping means, movable longitudinally of a loading table of the circular sheet pile feeder, for seizing the splayed pile of sheets and for transporting the same to the loading table, means for moving said gripping means, and means for sensing the end of the splayed pile of sheets on said loading table and for controlling said moving means in response to the sensed position of said end of the splayed pile of sheets on said loading table.

15. Apparatus according to claim 14, wherein said sensing means comprises a photodetector movable on said moving means with said gripping means and including means for adjusting the spacing between said photodetector and said gripping means.

16. Apparatus according to claim 11, wherein said stack of sheets is arranged on a pallet.

17. Apparatus according to claim 13, wherein said stack of sheets is arranged on a pallet.

18. Apparatus according to claim 15, wherein said stack of sheets is arranged on a pallet.

19. The method according to claim 5, further comprising, after the automatic splaying step, the step of conveying the splayed pile of sheets to a location for initiation of said automatic positioning step.

* * * * *